US005090681A

United States Patent [19]

Henn et al.

[11] Patent Number: 5,090,681

[45] Date of Patent: Feb. 25, 1992

[54] SHEET DELIVERY SYSTEM IN A SHEET-PROCESSING MACHINE

[75] Inventors: Manfred Henn, Heidelberg; Udo Ganter, Leutershausen; Peter T. Blaser, Dielheim, all of Fed. Rep. of Germany

[73] Assignee: Heidelberger Druckmaschinen AG, Heidelberg, Fed. Rep. of Germany

[21] Appl. No.: 546,537

[22] Filed: Jun. 29, 1990

[30] Foreign Application Priority Data

Jul. 10, 1989 [DE] Fed. Rep. of Germany ..... 3922587

[51] Int. Cl.[5] ..... B65H 31/12

[52] U.S. Cl. ..... 271/218; 414/790.8

[58] Field of Search ..... 271/207, 213–215, 271/217–219, 279, 287–290, 292, 294, 189; 414/790.8

[56] References Cited

U.S. PATENT DOCUMENTS

| | | | |
|---|---|---|---|
| 1,699,284 | 1/1929 | English et al. . | |
| 2,205,767 | 6/1940 | Lamb | 271/218 |
| 2,836,418 | 6/1958 | Blattner et al. . | |
| 2,847,215 | 8/1958 | Koch | 271/88 |
| 2,878,017 | 3/1959 | Blattner | 271/79 |
| 3,140,091 | 7/1964 | Reif et al. | 271/88 |
| 3,285,607 | 11/1966 | Lindemann . | |
| 3,960,374 | 6/1976 | Gaffney | 271/218 |
| 4,765,790 | 8/1988 | Besemann | 414/790.8 |
| 4,799,847 | 1/1989 | Bodewein | 414/790.8 |

FOREIGN PATENT DOCUMENTS

| | | | |
|---|---|---|---|
| 943772 | 6/1956 | Fed. Rep. of Germany . | |
| 1039072 | 9/1958 | Fed. Rep. of Germany . | |
| 1241465 | 6/1967 | Fed. Rep. of Germany | 271/218 |
| 1411767 | 10/1968 | Fed. Rep. of Germany . | |
| 3535113 | 4/1987 | Fed. Rep. of Germany . | |
| 8603162 | 7/1988 | Netherlands | 271/207 |
| 0648263 | 3/1985 | Switzerland | 414/790.8 |
| 1196687 | 7/1970 | United Kingdom | 271/218 |
| 1574895 | 9/1980 | United Kingdom | 271/217 |

*Primary Examiner*—H. Grant Skaggs
*Attorney, Agent, or Firm*—Nils H. Ljungman & Associates

[57] ABSTRACT

The invention relates to a sheet delivery system for a sheet-processing machine in which the sheets to be deposited are conveyed horizontally and are deposited on a sheet stack which is carried by a stacking table and lowered with increasing stacking height, said sheet delivery system comprising an auxiliary stacking table, the grate-like bars of which, can be inserted into the stacking area. Auxiliary guides are provided for facilitating the manual insertion and removal of the heavy auxiliary stacking table into and from the sheet stack.

15 Claims, 4 Drawing Sheets

20
19
18
13
5
6
9
8
10
12
7
15
11
14
17
4
16
1

20
19
18
34
13
5
6
9
8
10
12
7
15
11
17
14
PRINCIPAL STACKING TABLE
22
4
32
24
LOWERING AND RAISING APPARATUS
PRINTING PRESS
16
26
CONTROL FOR LOWERING AND RAISING APPARATUS
SHEET COUNTER
1
30
28
SHEET THICKNESS ADJUSTMENT

SHEET DELIVERY SYSTEM IN A SHEET-PROCESSING MACHINE

BACKGROUND OF THE INVENTION

1. Field of the Invention:

The invention relates to a sheet delivery system at a sheet-processing machine in which the sheets to be deposited are conveyed horizontally and are deposited on a sheet stack which is carried by a stacking table and is lowered as the stacking height increases so that the respective uppermost sheet is at a certain level, such sheet delivery comprising an auxiliary stacking table, the grate-like bars of which can be inserted into the stacking area.

2. Background Information

In a known embodiment of this kind such as U.S. Pat. No. 4,799,847 entitled "Sheet Stacker", which corresponds to Federal Republic of Germany Patent Publication, DE-OS 35 35 113 02, the auxiliary stacking table is provided with an insertion means which requires an additional frame part into which the auxiliary stacking table retracts when being in its considerably non-working position. This frame part extends the overall length and increases the overall size of the sheet-processing machine, e.g. a printing machine. Another disadvantage is to be seen in that, especially with large sheet sizes and heavy intermediate stacks, great technical efforts are needed to realize this known embodiment.

OBJECT OF THE INVENTION

On the basis of this state of the art it is the object of the present invention to facilitate the manual sliding-in and removing of the heavy auxiliary stacking table of an auxiliary stacking device.

SUMMARY OF THE INVENTION

According to the invention this object is achieved in that the auxiliary stacking table is aligned in a vertical non-working position by means of auxiliary guides and the auxiliary stacking table can be swiveled together with the guides into a horizontal slide-in position, and in that the auxiliary stacking table can be inserted in the stacking area by being moved along the auxiliary guides into guiding and bearing means. Such an auxiliary stacking table which is operated manually can be easily slid into the stacking area since the measures and embodiments according to the invention preferably prevent skewing reliably, in particular when inserting the auxiliary stacking table. Taking into account the close sequence of sheets, it has often been very difficult for the pressman to insert the auxiliary stacking table in a relatively short time, especially when using large sheet sizes. The vertical non-working position does without substantial additional space for the auxiliary stacking table, providing thus a rather inexpensive solution.

In an advantageous embodiment of the invention the auxiliary stacking table, in its non-working position, is vertically placed, on both sides thereof, on hooks which together with the auxiliary stacking table are guided, on both sides thereof, in auxiliary guides which can be swiveled from the vertical position into the horizontal one. The auxiliary stacking table is then guided into and mounted, on both sides thereof, in or on slide rails and then slid along the auxiliary guides into the stacking area. This simple and reliable solution can be realized with minimum technical efforts and facilitates the operation of the intermediate stacking device.

In an advantageous embodiment of the invention, the auxiliary guides are supported, on both sides thereof, by lifting means, preferably designed as gas-pressure springs, which enables the pressman to move and insert the auxiliary stacking table into the horizontal preferably without any great efforts and to lower the auxiliary stacking table, upon removal, preferably without manual aid so that it automatically moves into its vertical non-working position. If during non-stop operation the auxiliary stacking table is heavier due to a greater height of the auxiliary stack, for reasons of design and stability, the gas-pressure springs are embodied accordingly so that in this case, too, no substantial additional force is required.

An advantageous development is to be seen in that the gas-pressure springs are mounted on the auxiliary guides via bolt, so that the auxiliary guides are limited in their swiveling range by means of stop pins, and that the bearing parts are mounted so as to be lowered together with the auxiliary stacking table with increasing height of the intermediate stack.

One aspect of the invention resides broadly in an auxiliary stacking table for a sheet stacker for stacking sheets in a stacking area in which the stacker comprises: a principal stacking table for receiving the sheets; device for raising and lowering the principal stacking table; control device, connected to the raising and lowering device, for successively lowering the stacking table as a height of the sheets in a stack on the stacking table increases; the auxiliary stacking table comprising: bar device for being inserted into the stacking area to support sheets coming from the sheet delivery device; device for moving the bar device from a substantially vertical position to a substantially horizontal position in the stacking area; and device for attaching the auxiliary table to a frame member of the sheet stacker.

Another aspect of the invention resides broadly in an auxiliary stacking table for a stacker for stacking in a stacking area in which the stacker comprises: a principal stacking table for receiving the sheets; device for raising and lowering the principal stacking table; control device, connected to the raising and lowering device, for successively lowering the stacking table as a height of the sheets in a stack on the staking table increasing; the auxiliary stacking table comprising: bar device for being manually inserted into the stacking area to support sheets coming from the sheet delivery device; device for manually moving the bar device from a substantially vertical position to a substantially horizontal position in the stacking area.

Yet another aspect of the invention resides broadly in a printing press or the like comprising: printing device; device for feeding printed sheets from the printing device to a stacking area; an auxiliary stacking table for a sheet stacker for stacking sheets in a stacking area in which the stacker comprises: a principal stacking table for receiving the sheets; device for raising and lowering the principal stacking table; control device, connected to the raising and lowering device, for successively lowering the stacking table as a height of the sheets in a stack on the staking table increasing; the auxiliary stacking table comprising: bar device for being inserted into the stacking area to support sheets coming from the sheet delivery device; device for moving the bar device form a substantially vertical position to a substantially horizontally position in the stacking area; and device for attaching the auxiliary table to a frame member of the sheet stacker.

BRIEF DESCRIPTION OF THE DRAWINGS

A specimen embodiment of the invention is schematically represented in the drawings.

DESCRIPTION OF THE PREFERRED EMBODIMENT

Figure 1:
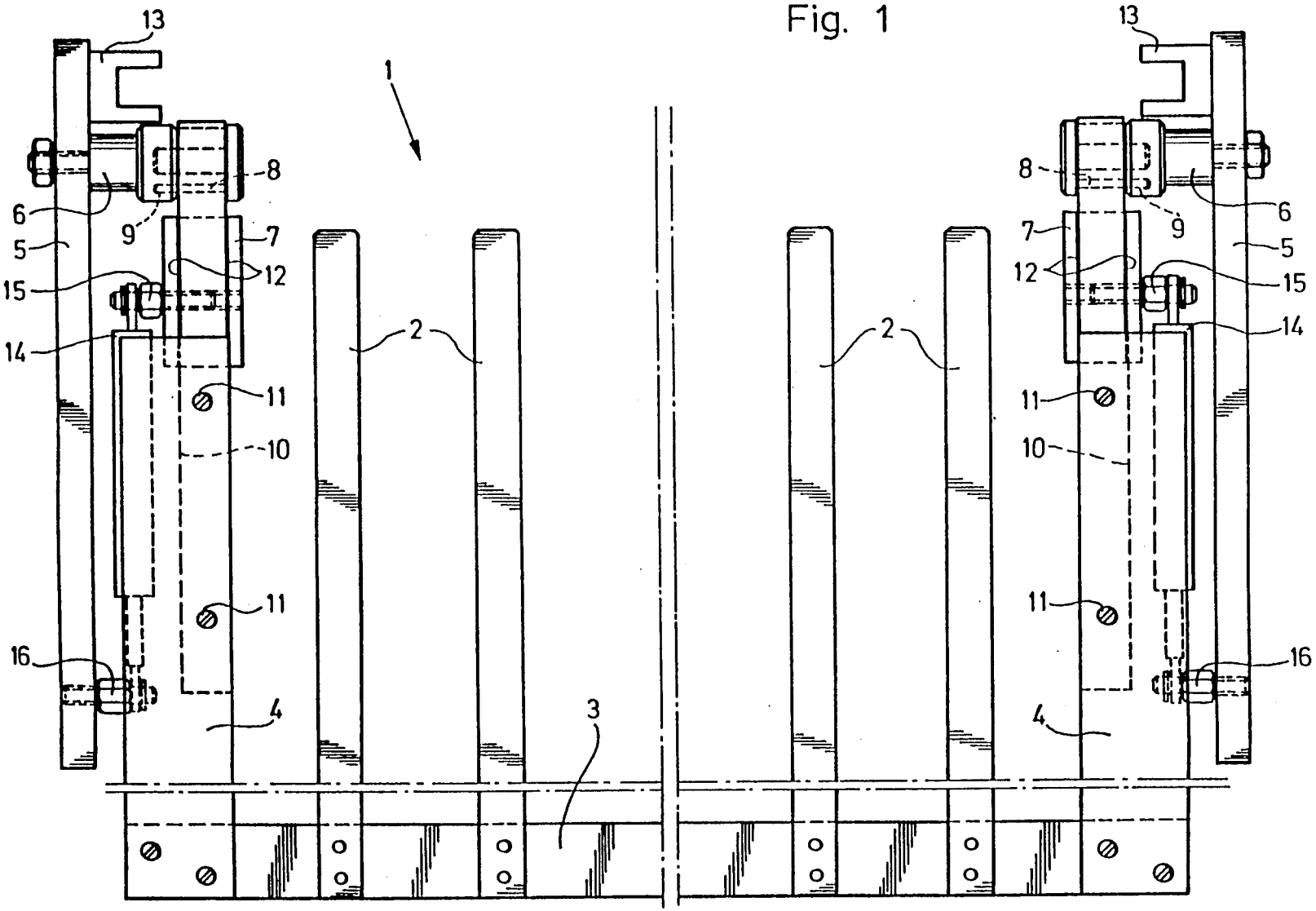
FIG. 1 is a plan view of the auxiliary stacking table.

The plan view of FIG. 1 shows the auxiliary stacking table 1 with its grate-like bars 2 in its non-working preferably vertical position. The bars 2 are fastened to a support 3 both sides of which are fastened to guiding rails 4. Outside the guiding rails 4 there are provided bearing parts 5 to which bearing pins 6 are fastened. The bearing parts 5 are preferably attached to a frame member 34 of the principal stacking table 22. Auxiliary guides 7 are pivot-mounted on the bearing pins 6, said auxiliary guide being limited in their swiveling range by means of stop pins 8 and slits 9 provided in the bearing pin 6, the stop pin 8 extending into said slits 9 (FIGS. 2 and 3).

Figure 2:
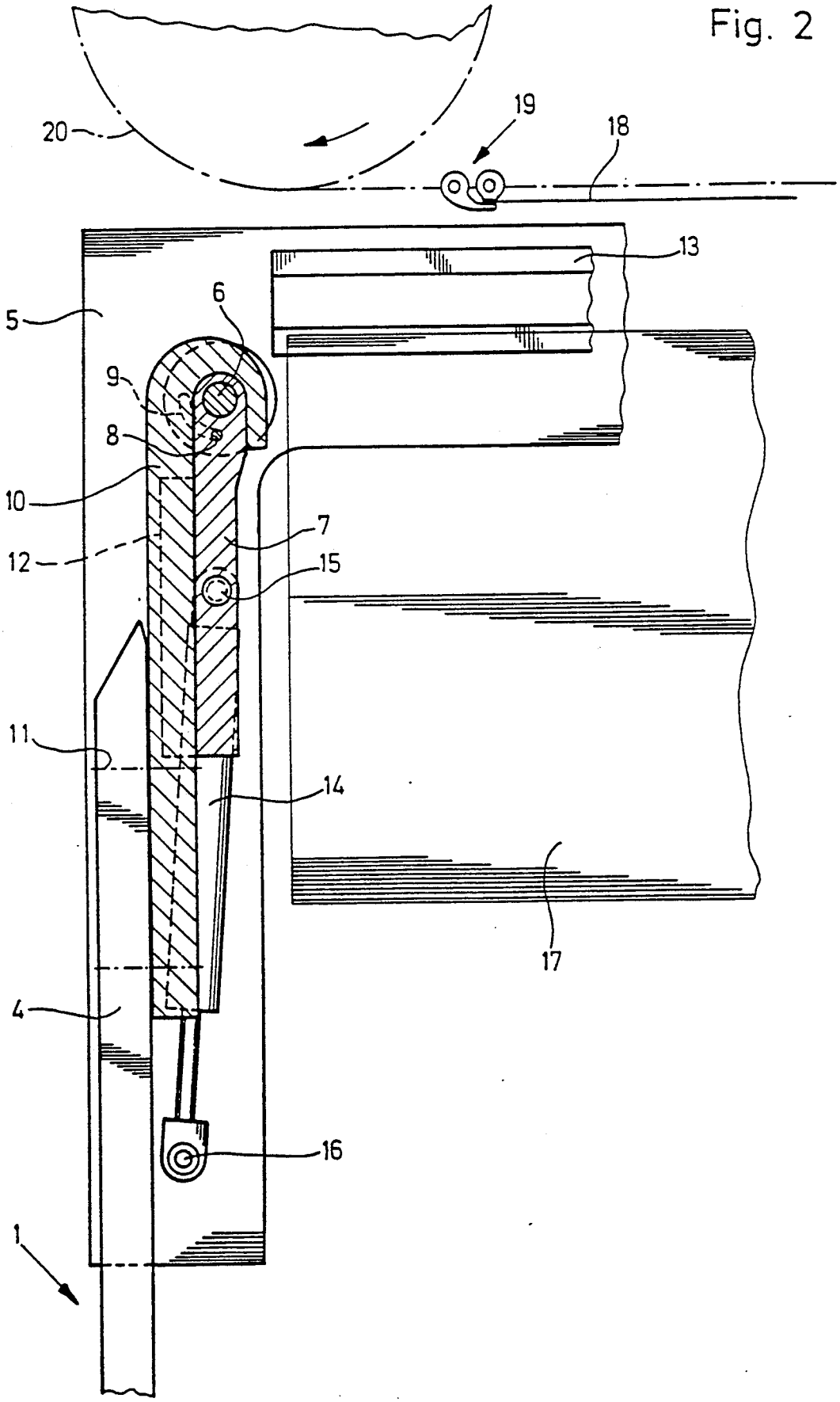
FIG. 2 shows the auxiliary stacking table in its vertical non-working position.
Figure 3:
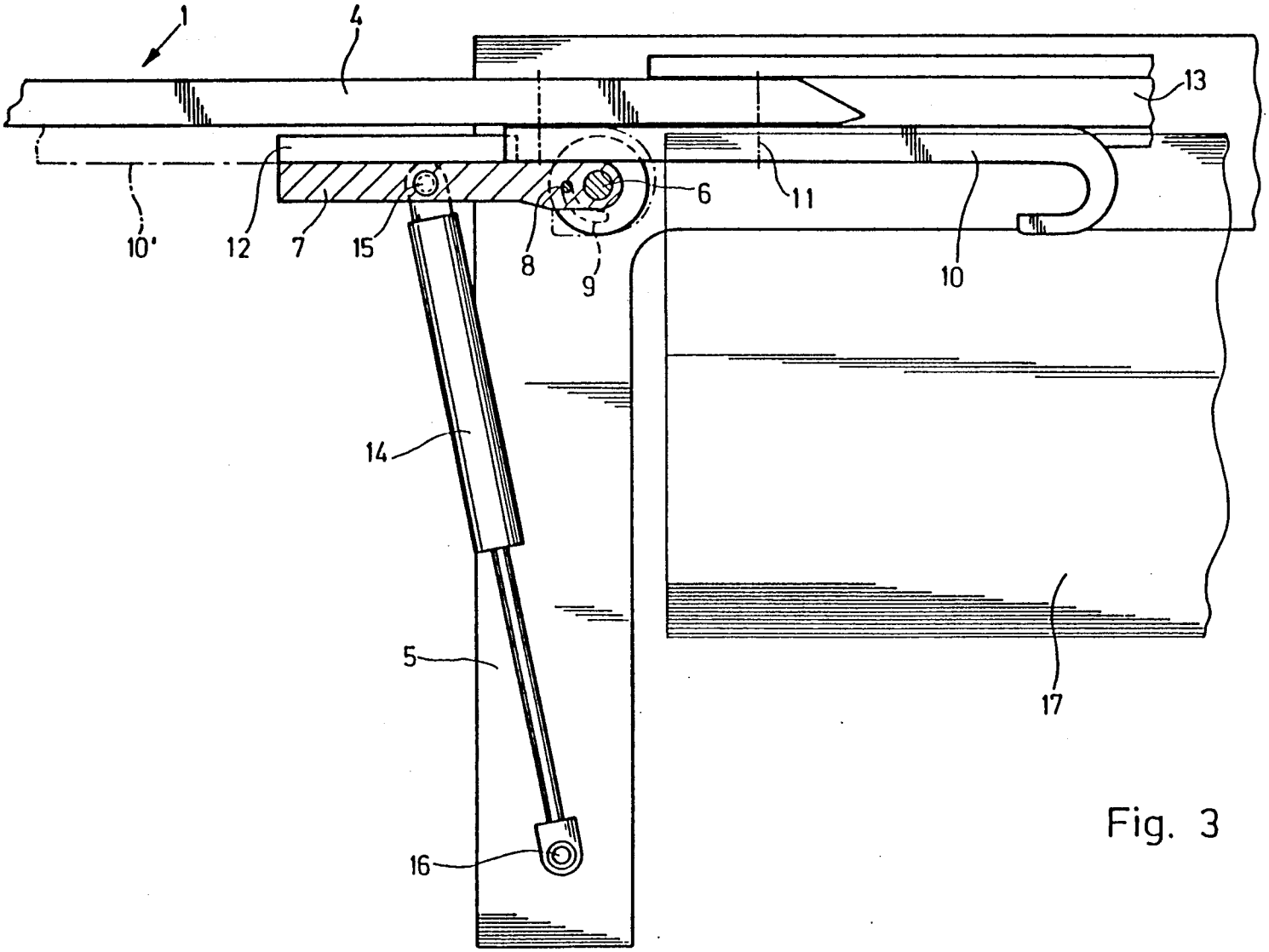
FIG. 3 shows the auxiliary stacking table being partly inserted.

In its vertical non-working position the guiding rails 4 of the auxiliary stacking table 1 are suspended from the auxiliary guides 7 in the area of the bearing pins 6 by means of hooks 10, as illustrated in FIGS. 1 and 2. The hooks 10 are fastened to the guiding rails 4 by means of screws and are guided in sliding guides 12 provided at the auxiliary guides 17 so as to be displaceable longitudinally.

By swiveling the auxiliary guides 7 into a horizontal position (FIG. 3) the auxiliary stacking table 1 can be slid from the auxiliary guides 7 into the sliding rails 13 provided on both sides of the bearing parts 5. At the beginning of the slide-in movement the auxiliary stacking table 1 is guided in the sliding guides 12 of the auxiliary guides 7 by means of the hooks 10 and during the further movement of the auxiliary stacking table 1 the guiding rails 4 are slid into the sliding rails 13, thus preventing skewing, when inserting the auxiliary stacking table 1. In FIG. 3 the starting position 10 of the hook 10 is indicated by a dash-dot line.

In order to make it easier for the pressman to swivel the heavy auxiliary stacking table 1 upwards the auxiliary guides 7 are provided, on both sides thereof, with lifting means in the form of gas-pressure springs 14 which are mounted on the auxiliary guides 7 via bolts 15, the opposite ends of said gas-pressure springs being fastened to bearing parts 6 also via bolts 16. In its non-working position according to FIG. 2 the gas-pressure springs 14 hold the auxiliary stacking table 1 vertically to the working position in an above-dead-center position. FIG. 3 shows the gas-pressure spring 14 in its extended position in which the auxiliary stacking table 1 is illustrated in a horizontal slide-in position. The force of the gas-pressure springs 14 is calculated and the gas-pressure springs 14 designed such that they provide somewhat less force that in the lifting force needed for the auxiliary stacking table 1.

When the sheet stack 17 which is carried by a stacking table reaches its maximum or desired height, the pressman swivels the auxiliary stacking table 1 into its horizontal position and slides it in the area of the stack 17. In so doing, he has to make sure that the following sheet 18 conveyed by the grippers 19 to the chain delivery 20 is deposited on the bars 2 of the auxiliary stacking table 1. Thereafter the full sheet stack 17 can be removed from the machine and a new stacking table can be inserted. The bearing parts 5 are mounted so as to be lowerable in accordance with the increasing stacking height of the auxiliary stack so that, when using e.g. thick sheet material, the auxiliary stacking table can receive a greater stacking height.

Figure 4:
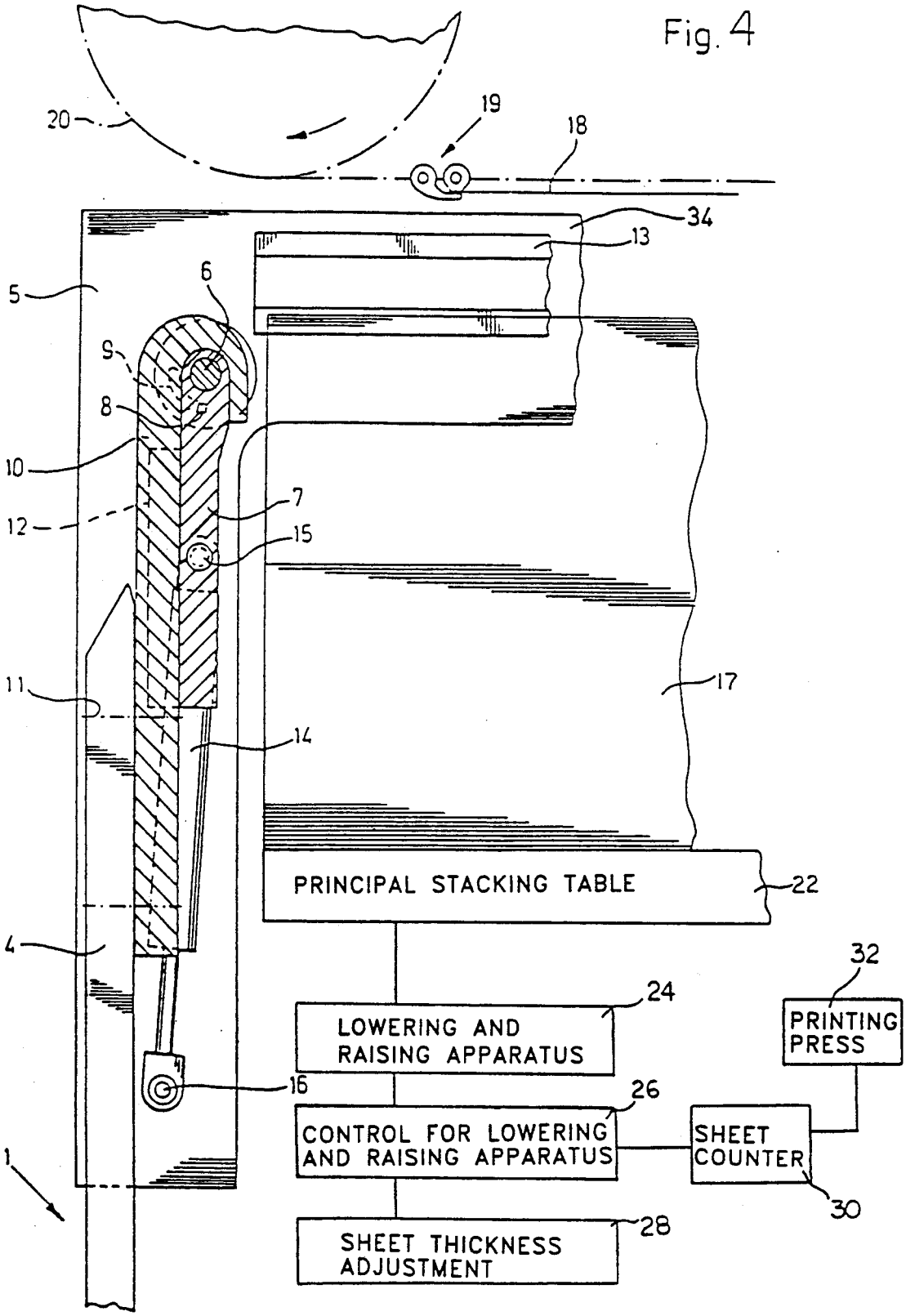
FIG. 4 shows an alternative embodiment of the auxiliary stacking table in its vertical position.

Now, referring to FIG. 4, the auxiliary stacking table is preferably attached to the frame 34 of the principal stacking table 22 so that the auxiliary stacking table 1 will preferably move with the principal stacking table 22 and be lowered as the stack on the auxiliary stacking table 1 increases in height. The principal stacking table 22 supports the sheet stack 17 and is lowered and also raised by principal stacking table 22 lowering and raising apparatus 24 which is controlled by a control for lowering and raising apparatus 26. A sheet thickness adjustment 28 and a sheet counter 30, which sheet counter 30 receives count signals from printing press 22, cooperate to lower the principal stacking table 22 to keep the upper level of the sheet stack 17 at a generally constant height as is well known in the prior art.

Control regulating apparatus for sheet delivery systems are found in U.S. pat. No. 4,643,414 entitled, "Sheet-Delivery Control and Regulating Apparatus.

List of Parts:

| | |
|---|---|
| 1. auxiliary stacking table | 11. screw |
| 2. bar | 12. sliding guide |
| 3. support | 13. sliding rail |
| 4. guiding rail | 14. gas-pressure spring |
| 5. bearing part | 15. bolt |
| 6. bearing pin | 16. bolt |
| 7. auxiliary guide | 17. sheet stack |
| 8. stop pin | 18. sheet |
| 9. slit | 19. gripper |
| 10. hook | 20. chain delivery |

In summary, one feature of the invention resides broadly in a sheet delivery at a sheet-processing machine in which the sheets to be deposited are conveyed horizontally and are deposited on a sheet stack which is carried by a stacking table and is lowered with increasing stacking height so that the respective uppermost sheet is at a certain level, said sheet delivery comprising an auxiliary stacking table the grate-like bars of which can be inserted in the stacking area, characterized in that an auxiliary stacking table 1 is aligned by means of auxiliary guides 7 in a substantially vertical non-working position and can be swiveled together with said auxiliary guides into a horizontal slide-in position, and that said auxiliary stacking table 1 can be inserted in the stacking area by being moved from said auxiliary guides 7 into guiding and bearing parts 13.

Another feature of the invention resides broadly in sheet delivery characterized in that its non-working position said auxiliary stacking table 1, on both sides thereof, is vertically placed on hooks 10, that, on both sides thereof, said hooks 10 together with said auxiliary stacking table 1 are guided in said auxiliary guides 7 which can be swiveled from a vertical position into a horizontal one, and that said auxiliary stacking table 1 is guided in and mounted, on both sides thereof, on sliding rails 13, when being slid from said auxiliary guides 7 into the stacking area.

Yet another feature of the invention resides broadly in a sheet delivery characterized in that said auxiliary guides 7 are supported on both sides thereof by lifting means, preferably designed as gas-pressure springs 14.

A further feature of the invention resides broadly in a sheet delivery characterized in that said gas-pressure springs 14 are mounted on said auxiliary guides 7 via bolts 15, and that said auxiliary guides 7 are limited in their swiveling range by means of stop pins 8.

A yet further feature of the invention resides broadly in a sheet delivery characterized in that said bearing parts 4–6 and said auxiliary stacking table 1 are mounted so as to be lowerable with increasing height of the intermediate stack.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. An auxiliary stacking table for a sheet stacker for stacking sheets in a stacking area in which the sheet stacker comprises:
- a principal stacking table for receiving the sheets;
- means for raising and lowering the principal stacking table;
- control means, connected to the raising and lowering means, for successively lowering the stacking table as a height of the sheets in a stack on the stacking table increases;
- said auxiliary stacking table comprising:
  - bar means for being inserted into the stacking area to support sheets coming from a sheet delivery apparatus;
  - means for attaching said auxiliary table to a frame member of the sheet stacker;
  - bar moving means for moving said bar means from a substantially vertical position to a substantially horizontal position, said bar moving means comprising:
    - holding means for holding said bar means in the substantially vertical, non-working position;
    - said holding means comprising guiding means for guiding said bar means;
    - swiveling means for swiveling said bar means together with said guiding means from the substantially vertical position to the substantially horizontal position such that said bar means swivels from the substantially vertical, non-working position to the substantially horizontal position adjacent the stacking area; and
  - means for horizontally moving said bar means into the stacking area.

2. An auxiliary stacking table according to claim 1, wherein said means for horizontally moving said bar means includes means for sliding said bar means in said guiding means and means for horizontally holding said bar means in the stacking area.

3. An auxiliary stacking table according to claim 2, further including:
- said bar holding means comprising hook means;
- said bar means comprising two sides;
- said hook means cooperating with said guiding means to hold said bar means vertically;
- said hook means being disposed on both sides of said bar means;
- said guiding means comprising guide structures for receiving and being clasped by said hook means on both sides of said bar means;
- said swiveling means including means for swiveling said guide structures and said hook means from the vertical to the horizontal position;
- said auxiliary table comprising two sides; and
- said means for horizontally moving said bar means comprising sliding rails on both sides of said auxiliary table for guiding said bar means into the stacking space when being slid from said guide structures.

4. An auxiliary stacking table according to claim 3, wherein said guide structures have lifting means attached thereto for assisting in lifting said guide structures.

5. An auxiliary stacking table according to claim 4, wherein said lifting means comprises gas filled spring means.

6. An auxiliary stacking table according to claim 5, further including:
- said gas filled spring means being mounted to said guide structures with bolts; and
- stop pins for limiting swiveling of said guide structures.

7. An auxiliary stacking table according to claim 6, further including means for lowering said auxiliary stacking table with increasing height of a stack thereon.

8. An auxiliary stacking table for a stacker for stacking in a stacking area in which the stacker comprises:
- a principal stacking table for receiving the sheets;
- means for raising and lowering the principal stacking table;
- control means, connected to the raising and lowering means, for successively lowering the stacking table as a height of the sheets in a stack on the stacking table increases;
- said auxiliary stacking table comprising:
  - bar means for being manually inserted into the stacking area to support sheets coming from the sheet delivery means;
  - bar moving means for moving said bar means from a substantially vertical position to a substantially horizontal position, said bar moving means comprising:
    - holding means for holding said bar means in the substantially vertical, non-working position;
    - said holding means comprising guiding means for guiding said bar means;
    - swiveling means for swiveling said bar means together with said guiding means from the substantially vertical position to the substantially horizontal position such that said bar means swivels from the substantially vertical, non-working position to the substantially horizontal position adjacent the stacking area; and means for horizontally moving said bar means into the stacking area.

9. An auxiliary stacking table according to claim 8, wherein said means for horizontally moving said bar means includes means for sliding said bar means in said guiding means and means for horizontally holding said bar means in the stacking area.

10. An auxiliary stacking table according to claim 9, further including:

said bar holding means comprising hook means;

said hook means cooperating with said guiding means to hold said bar means vertically;

said bar means comprising two sides;

said hook means being disposed on both sides of said bar means;

said guiding means comprising guide structures for receiving and being clasped by said hook means on both sides of said bar means;

said swiveling means including means for swiveling said guide structures and said hook means from the vertical to the horizontal position;

said auxiliary table comprising two sides; and said means for horizontally moving said bar means comprising sliding rails on both sides of said auxiliary table for guiding said bar means into the stacking space when being slide from said guide structures.

11. An auxiliary stacking table according to claim 10, further including:

said guide structures having lifting means attached thereto for assisting in lifting said guide structures;

said lifting means comprising gas filled spring means;

said gas filled spring means being mounted to said guide structures with bolts;

stop pins for limiting swiveling of said guide structures; and means for lowering said auxiliary stacking table with increasing height of a stack thereon.

12. A printing press or the like comprising:

printing means;

means for feeding printed sheets from said printing means to a stacking area;

an auxiliary stacking table for a sheet stacker for stacking sheets in a stacking area in which the stacker comprises:

a principal stacking table for receiving the sheets;

means for raising and lowering the principal stacking table;

control means, connected to the raising and lowering means, for successively lowering the stacking table as a height of the sheets in a stack on the stacking table increases;

said auxiliary stacking table comprising:

bar means for being inserted into the stacking area to support sheets coming from the sheet delivery means for feeding printed sheets;

means for attaching said auxiliary table to a frame member of the sheet stacker;

bar moving means for moving said bar means from a substantially vertical position to a substantially horizontal position, said bar moving means comprising:

holding means for holding said bar means in the substantially vertical, non-working position;

said holding means comprising guiding means for guiding said bar means;

swiveling means for swiveling said bar means together with said guiding means from the substantially vertical position to the substantially horizontal position such that said bar means swivels from the substantially vertical, non-working position to the horizontal position adjacent the stacking area; and means for horizontally moving said bar means into the stacking area.

13. A printing press according to claim 12, wherein said means for horizontally moving said bar means includes means for sliding said bar means in said guiding means and means for horizontally holding said bar means in the stacking area.

14. A printing press according to claim 13, further including:

said bar holding means comprising hook means;

said hook means cooperating with said guiding means to hold said bar means vertically;

said hook means being disposed on both sides of said bar means;

said bar means comprising two sides;

said guiding means comprising guide structures for receiving and being clasped by said hook means on both sides of said bar means;

said swiveling means including means for swiveling said guide structures and said hook means from the vertical to the horizontal position;

said auxiliary table comprising two sides; and said means for horizontally moving said bar means comprising sliding rails on both sides of said auxiliary table for guiding said bar means into the stacking space when being slid from said guide structures.

15. A printing press according to claim 14, further including:

said guide structures having lifting means attached thereto for assisting in lifting said guide structures;

said lifting means comprising gas filled spring means;

said gas filled spring means being mounted to said guide structures with bolts;

stop pins for limiting swiveling of said guide structures; and means for lowering said auxiliary stacking table with increasing height of a stack thereon.

* * * * *

UNITED STATES PATENT AND TRADEMARK OFFICE

CERTIFICATE OF CORRECTION

PATENT NO. : 5,090,681

DATED : February 25, 1992

INVENTOR(S) : Manfred HENN, Udo GANTER, Peter T. BLASER

It is certified that error appears in the above-identified patent and that said Letters Patent is hereby corrected as shown below:

In column 1, line 21, delete "DE-OS 35 35 113 02" and insert --DE-OS 35 35 113 C2--.

In column 3, line 36, after 'guides', delete "17" and insert --7--.

In column 3, line 67, after 'by', delete "a" and insert --principal--.

In column 3, line 68, after 'table', insert --22--.

In Claim 10, line 19, after 'being', delete "slide" and insert --slid--.

Signed and Sealed this

Twenty-first Day of September, 1993

Bruce Lehman

*Attest:*

BRUCE LEHMAN

*Attesting Officer*

*Commissioner of Patents and Trademarks*